US007849929B2

(12) United States Patent
Littlely

(10) Patent No.: US 7,849,929 B2
(45) Date of Patent: Dec. 14, 2010

(54) DRILL ROD SPINNER DEVICE

(75) Inventor: Keith William Littlely, Balcatta (AU)

(73) Assignee: Longyear TM, Inc., South Jordan, UT (US)

( * ) Notice: Subject to any disclaimer, the term of this patent is extended or adjusted under 35 U.S.C. 154(b) by 201 days.

(21) Appl. No.: 12/119,385

(22) Filed: May 12, 2008

(65) Prior Publication Data

US 2009/0277626 A1 Nov. 12, 2009

(51) Int. Cl.
*E21B 19/16* (2006.01)

(52) U.S. Cl. ..... 166/380; 166/77.51; 81/57.17; 81/57.2

(58) Field of Classification Search ..... 166/77.51, 166/380; 81/57.17, 57.19, 57.2, 57.33, 57.34
See application file for complete search history.

(56) References Cited

U.S. PATENT DOCUMENTS

| | | | | |
|---|---|---|---|---|
| 430,994 | A | 6/1890 | Ely | |
| 621,293 | A | 3/1899 | Crass | |
| 712,253 | A | 10/1902 | Brown et al. | |
| 1,416,685 | A | 5/1922 | Bufford | |
| 2,633,045 | A | 3/1953 | Lurie | |
| 2,928,301 | A | 7/1957 | Beeman et al. | |
| 2,921,489 | A | 1/1960 | Schweitzer | |
| 3,880,024 | A | 4/1975 | Asada | |
| 3,892,140 | A * | 7/1975 | Fox et al. | 474/121 |
| 4,079,640 | A | 3/1978 | Golden | |
| 4,212,212 | A * | 7/1980 | Chandler et al. | 81/57.17 |
| 4,221,269 | A | 9/1980 | Hudson | |
| 4,324,157 | A * | 4/1982 | Soutsos | 81/57.17 |
| 4,512,216 | A | 4/1985 | Callegari, Sr. et al. | |
| 4,604,922 | A | 8/1986 | Soutsos | |
| 4,683,962 | A | 8/1987 | True | |
| 4,694,712 | A | 9/1987 | Doss | |
| 4,765,401 | A | 8/1988 | Boyadjieff | |

(Continued)

FOREIGN PATENT DOCUMENTS

DE 29720465 1/1998

(Continued)

OTHER PUBLICATIONS

U.S. Appl. No. 61/052,577, filed May 12, 2008, Trevor Lyndon Light.

(Continued)

*Primary Examiner*—Giovanna C Wright
(74) *Attorney, Agent, or Firm*—Workman Nydegger

(57) ABSTRACT

A drill rod spinner device includes a mount, a first base half having a first end and a second end in which the first base half at the first end is rotatably coupled to the mount and a first clamping roller operatively associated with the second end of the first base half. A second base half includes a first end and a second end in which the second base half at the first end is coupled to the mount. A second clamping roller is operatively associated with the second end of the second base half. A rotary actuator assembly is secured to the mount. A flexible belt is operatively associated with the rotary actuator assembly. An idler roller assembly maintains engagement between the flexible belt and the rotary actuator as the first base half is rotated relative to the mount.

29 Claims, 10 Drawing Sheets

U.S. PATENT DOCUMENTS

| | | | | |
|---|---|---|---|---|
| 4,843,924 | A | 7/1989 | Hauk | |
| 4,885,963 | A | 12/1989 | Nishikawa | |
| 4,895,056 | A | 1/1990 | Schulze-Beckinghausen | |
| 5,054,550 | A | 10/1991 | Hodge | |
| 5,060,542 | A | 10/1991 | Hauk | |
| 5,092,411 | A | 3/1992 | Hausherr et al. | |
| 5,207,128 | A | 5/1993 | Albright | |
| 5,320,021 | A | 6/1994 | Heintz | |
| 5,660,087 | A | 8/1997 | Rae | |
| 5,845,549 | A | 12/1998 | Bouligny | |
| 5,868,045 | A | 2/1999 | Hauk | |
| 5,931,231 | A | 8/1999 | Mock | |
| 6,070,500 | A | 6/2000 | Diask et al. | |
| 6,082,225 | A | 7/2000 | Richardson | |
| 6,318,199 | B1 | 11/2001 | Buck | |
| 6,634,443 | B1 | 10/2003 | Paech et al. | |
| 6,910,402 | B2 | 6/2005 | Drzewiecki | |
| 6,971,283 | B2 | 12/2005 | Belik | |
| 7,000,502 | B2 * | 2/2006 | Belik | 81/57.2 |
| 7,117,938 | B2 | 10/2006 | Hamilton et al. | |
| 7,188,547 | B1 | 3/2007 | West et al. | |
| 7,191,686 | B1 | 3/2007 | Angelle et al. | |
| 2002/0157823 | A1 | 10/2002 | Pietras et al. | |
| 2003/0221871 | A1 | 12/2003 | Hamilton et al. | |
| 2005/0072274 | A1 | 4/2005 | Hauk et al. | |
| 2006/0053977 | A1 | 3/2006 | Hawkins, III | |
| 2006/0054331 | A1 | 3/2006 | Hawkins. III | |
| 2006/0179980 | A1 | 8/2006 | Pietras et al. | |
| 2006/0243490 | A1 | 11/2006 | Riel | |
| 2007/0017703 | A1 * | 1/2007 | Belik | 175/52 |

FOREIGN PATENT DOCUMENTS

| | | | |
|---|---|---|---|
| DE | 20202396 | | 6/2002 |
| EP | 1644608 | B1 | 11/2007 |
| JP | 62-156468 | | 10/1987 |
| JP | 07-062968 | | 3/1995 |
| JP | 09-250285 | | 9/1997 |
| JP | 2652808 | B2 | 9/1997 |
| JP | 2002-194984 | | 7/2002 |
| JP | 2003-184471 | A | 7/2003 |
| WO | WO98/26153 | | 6/1998 |
| WO | WO99/06186 | | 2/1999 |
| WO | WO99/55728 | | 11/1999 |
| WO | WO03/033858 | | 4/2004 |

OTHER PUBLICATIONS

U.S. Appl. No. 12/138,297, filed Jun. 12, 2008, Lauzon, et al.
U.S. Appl. No. 12/197,817, filed Aug. 25, 2008, Kruse, et al.
International Search Report and Written Opinion dated Oct. 28, 2009 as issued in International Application No. PCT/US2009/043628 filed May 12, 2009.
www.scorpion.com—Scorpion Oil Tools 400 Series (1 page).
Office Action dated Jan. 25, 2010 from U.S. Appl. No. 12/138,297 filed Jun. 12, 2008 (6 pages).
Office Action dated May 27, 2010 from U.S. Appl. No. 12/138,297 filed Jun. 12, 2008 (7 pages).
Office Action dated Jan. 13, 2010 from U.S. Appl. No. 12/197,817 filed Aug. 25, 2008 (6 pages).
Office Action dated May 20, 2010 from U.S. Appl. No. 12/197,817 filed Aug. 25, 2008 (10 pages).
International Search Report dated Dec. 23, 2008 from PCT/US2008/067007 (4 pages).
Written Opinion dated Dec. 23, 2008 from PCT/US2008/067007 (6 pages).
International Search Report dated Jan. 21, 2009 from PCT/US2008/074499 (3 pages).
Written Opinion dated Jan. 21, 2009 from PCT/US2008/074499 (4 pages).
International Search Report dated Dec. 1, 2009 from PCT/US2009/043633 (3 pages).
Written Opinion dated Dec. 1, 2009 from PCT/US2009/043633 (3 pages).

* cited by examiner

DRILL ROD SPINNER DEVICE

BACKGROUND OF THE INVENTION

1. The Field of the Invention

The present disclosure relates to drilling devices and to devices for making and breaking connections between drill rods in a drill string in particular.

2. The Relevant Technology

Drilling rigs are often used for drilling holes into various substrates. Such drill rigs often include a drill head mounted to a generally vertically oriented mast. The rig often includes mechanisms and devices that are capable of moving the drill head along at least a portion of the mast. The drill head often further includes mechanisms that receive and engage the upper end of a drill rod or pipe. The drill rod or pipe may be a single rod or pipe or may be part of a drill string that includes a cutting bit or other device on the opposing end, which may be referred to as a bit end. In the case of a drill string, the drill string may include multiple rods, each of which has a length that is shorter than the usable length of the mast.

The drill head also applies a force to the drill rod or pipe which is transmitted to the drill string. If the applied force is a rotational force, the drill head may thereby cause the drill string rotate within the bore hole. The rotation of the drill string may include the corresponding rotation of the cutting bit, which in turn may result in cutting action by the drill bit. The forces applied by the drill head may also include a generally downward force, which may be transmitted to the drill string to facilitate penetration into the substrate.

In a typical drilling operation in which the drill bit penetrates to depth that is deeper than a single rod, a head end of a drill rod is coupled to the drill head while the bit end of the rod is coupled to a head end of another drill rod. The junction between the drill rods may be referred to as a joint. The drill head is advanced from advanced from an upper position until the drill head approaches the lower end of the mast. Once the drill head has reached the lower end of the mast, a clamp or other device is used to maintain the drill string in position relative to the mast.

A breakout tool is then applied between the clamp and the joint by an operator, who is often in close proximity to the drill mast. The joint between the drill head and the first drill pipe is then disconnected (broken) via counter-rotation of the drill head. The drill head is then raised to the upper end of the mast in preparation for engagement of another drilling pipe. A new length of drilling pipe is then positioned along the centreline of the mast via the drilling rig-specific pipe handling means and the drill head is rotatingly coupled to the new drilling pipe to a manufacturer-specified torque. The drill head is then lowered such that the lower (male) end of the drill pipe is engaged into the upper (female) end of the drill string, the new drill pipe is then manually rotated into the top of the exposed drill pipe in order to accurately make the joint and then torqued to a manufacturer-specified torque via the drill head. This process is continually repeated as the drilling of the borehole continues until the desired depth is reached. Such a process may be time consuming and may place the operator in undesirable proximity to the drill mast. Further, repetitive manual movements may subject the operator to risk of injuries associated with such repetitive movements. A similar operation is often performed in removing drill rods from a drill string, which may also be time consuming and wearing on the operator.

The subject matter claimed herein is not limited to examples that solve any disadvantages or that operate only in environments such as those described above. Rather, this background is only provided to illustrate one exemplary technology area where some examples described herein may be practiced.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In at least one example, a drill rod spinner device includes a mount, a first base half having a first end and a second end in which the first base half at the first end is rotatably coupled to the mount and a first clamping roller operatively associated with the second end of the first base half. A second base half includes a first end and a second end in which the second base half at the first end is coupled to the mount. A second clamping roller is operatively associated with the second end of the second base half. A rotary actuator assembly is secured to the mount. A flexible belt is operatively associated with the rotary actuator assembly. An idler roller assembly maintains engagement between the flexible belt and the rotary actuator as the first base half is rotated relative to the mount.

According to another example, a drill rod spinner device includes a rotary actuator assembly, a first clamping roller having gripping features associated therewith, a second clamping roller, an idler roller assembly, and a flexible belt engaging the rotary actuator assembly and the idler roller assembly, the first clamping roller, and the second clamping roller. The idler roller assembly is configured to cooperate with the first clamping roller and the second clamping roller to move the flexible belt to rotate an elongate member relative to an adjacent elongate member to and to pull elongate member into the gripping features on the first clamping roller to torque the elongate member relative the adjacent elongate member.

In another example, a method of spinning an elongate member includes moving a drill rod spinner device into engagement with an elongate member, the drill rod spinner device including a rotary actuator assembly, a first clamping roller having gripping features associated therewith, a second clamping roller, an idler roller assembly; and a flexible belt engaging the rotary actuator assembly and the idler roller assembly. The method also includes rotating the rotary actuator assembly at a first speed to drive the flexible belt to rotate the elongate member and rotating the rotary actuator assembly at a second speed to pull the elongate member into gripping features associated with at least one of the first clamping roller and the second clamping roller to apply torque to the elongate member at least partially with at least one of the first clamping roller and the second clamping roller, the second speed being lower than the first speed.

These and other features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present disclosure, a more particular description of the disclosure will be rendered by reference to specific examples thereof which are illustrated in the appended drawings. It is appreciated that these drawings depict only typical examples of the disclosure and are therefore not to be considered limiting of its scope. The disclosure will be described and explained with additional specificity and detail through the use of the accompanying drawings in which.

DETAILED DESCRIPTION OF THE PREFERRED EMBODIMENTS

A drill rod spinner device is provided herein that is configured to make and/or break joints between drill rods to facilitate introduction and/or removal of drill rods to and/or from a drill string as part of a drilling operation. In at least one example, the drill rod spinner device is configured to engage elongate members, such as drill rods, of varying sizes and/or shapes. The drill rod spinner device may include a flexible belt that is driven by a rotary actuator device. The flexible belt is routed around a number of pulleys, including around and between two clamping pulleys. The flexible belt between the two clamping pulleys may be formed into a loop that engages an elongate member. For example, the clamping pulley may be coupled to a hinged, two-part base that is configured to move between a rest state in which the clamping pulleys are separated and an engaged state in which the pulleys are brought toward each other. The relationship between the pulleys and the belt allows the belt to automatically engage elongate members and to apply rotating forces to the elongate members.

Further, during a drilling operation in which drill rods are to be added, the configuration of the drill rod spinner device quickly rotates an engaged drill rod into engagement with an adjacent drill rod during a first stage of the process and then seamlessly transitions to a second stage to automatically torque the drill rod to a desired torque. Similarly, the drill rod spinner device may torque a drill rod to thereby break the joint between a drill rod and an adjacent drill rod during a first stage of a drill rod removal process and then seamlessly transition to a second stage to quickly decouple the drill rod from the adjacent drill rod.

Figure 1A:
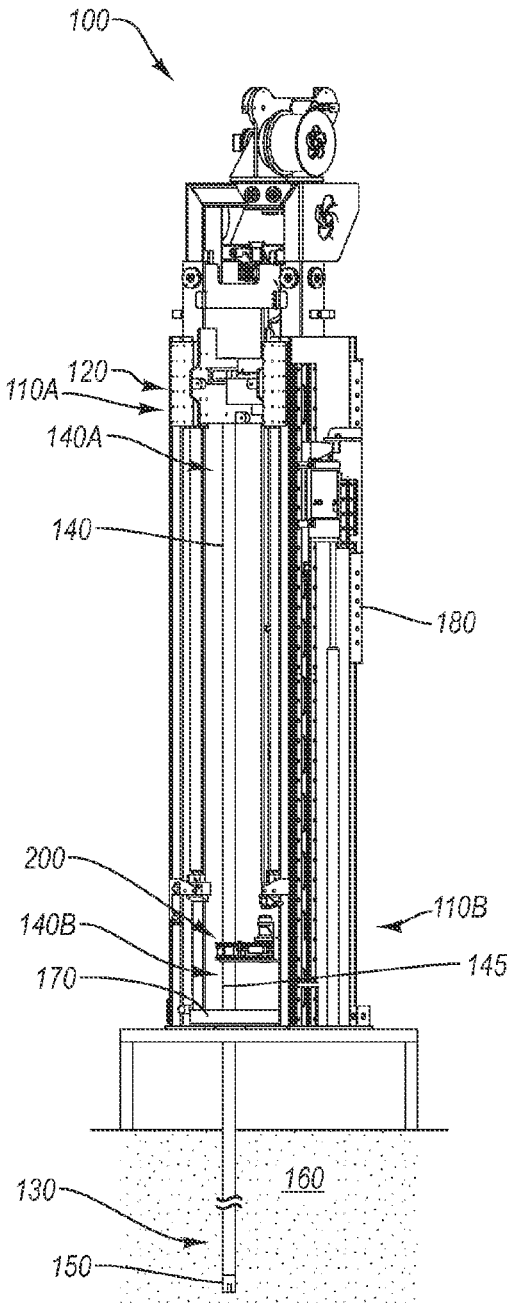
FIG. 1A illustrates a drill rig with a drill rod spinner device associated therewith according to one example.

FIG. 1A is a partial elevation view of a drill rig 100 that has a drill rod spinner device 200 associated therewith. In the illustrated example, the drill rig 100 includes a mast 110 that supports a drill head 120. In particular, the mast 110 supports the drill head 120 as the drill head 120 translates between an upper end 110A and a lower end 110B of the mast 110. While the mast 110 is illustrated as being vertically oriented, it will be appreciated that the mast 110 may be oriented at any angle as desired.

The drill head 120 is operatively associated with a drill string 130 that may include any number of drill rods 140. The drill head 120 includes mating features configured to engage corresponding mating features in a head or upper end 140A of the drill rod 140. In at least one example, the drill head 120 includes male features, such as external threads, while the head end 140A of the drill rod 140 includes female features, such as internal threads. Accordingly, the female features on the drill rod 140 may be rotated into engagement with the male features on the drill head 120.

Further, a bit end 140B of the drill rod 140 may include male features, such as external threads, that may be similarly coupled with additional drill rods to form the drill string 130. The junction between adjacent drill rods may be referred to as a joint 145. While upper ends (head ends) are described as having male features, such as internal threads, and the lower ends (bit ends) are described as having female features, such as internal threads, individual drill rods may be mated to other drill rods in any manner.

A drill bit 150 is operatively associated with a lower end of the drill string 130. The drill head 120 applies forces to the drill string 130, which are at least partially transmitted to the drill bit 150 to thereby cause the drill bit 150 to advance through a substrate 160. The forces applied to the drill string 130 may include, without limitation, rotary, downward, percussive, and/or vibratory as well as any combination of forces.

For ease of reference, the following examples will be discussed in the context of a drill head that is configured to apply rotary and downward forces to the drill string 130 and thence the drill bit 150. In at least one example, the rotary forces may be described as rotation in a first direction, which may be a clockwise direction. For ease of reference, a second direction will also be described, which may be counter clockwise. These designations are arbitrary and the devices may be rotated as desired.

As introduced, the rig 100 includes machinery and/or devices for translating the drill head 120 relative to the mast 110. This translation includes lowering the drill head 120 as the drill bit 150 penetrates the substrate 160. In at least one example, the rig 100 includes a clamping mechanism, illustrated as clamping device 170, as well as the drill rod spinner device 200 operatively associated therewith. During a drilling operation, both the clamping device 170 as well as the drill rod spinner device 200 may be disengaged from the drill string 130 to allow the drill string to move freely. As will be discussed in more detail below, the drill rod spinner device 200 may be utilized to quickly rotate a drill rod into connection with an adjacent drill rod during a first stage and to seamless transition to a second stage in which the drill rod is torqued to an additional drill rod to secure the joint between the two drill rods.

Figure 1B:
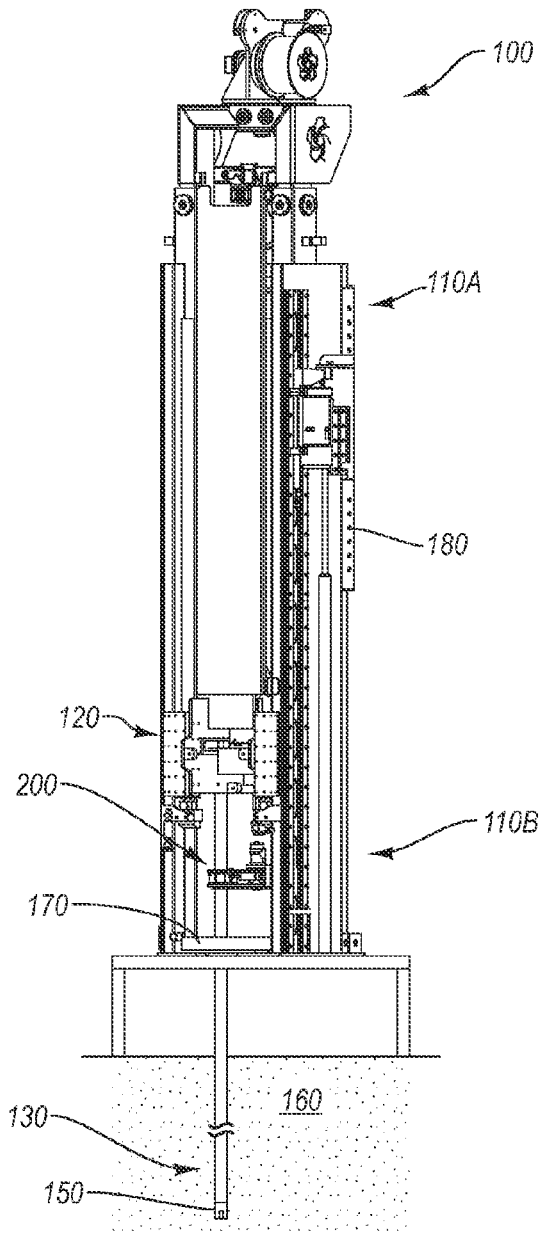
FIG. 1B illustrates a drill rig in which a drill head is near a lower end of a mast according to one example.

In particular, as illustrated in FIG. 1B, the drill head 120 may be lowered until the drill head 120 approaches the lower end 110B of the useful range of the mast 110. As the drill head 120 approaches the lower end 110B of the mast 110, the clamping device 170 may be deployed to grip the drill rod 140 with sufficient force to prevent rotation of the drill rod 140 as the drill head 120 is rotated in the second direction. As the drill head 120 is rotated in the second direction, the drill head 120 is decoupled from the drill rod 140.

Figure 1C:
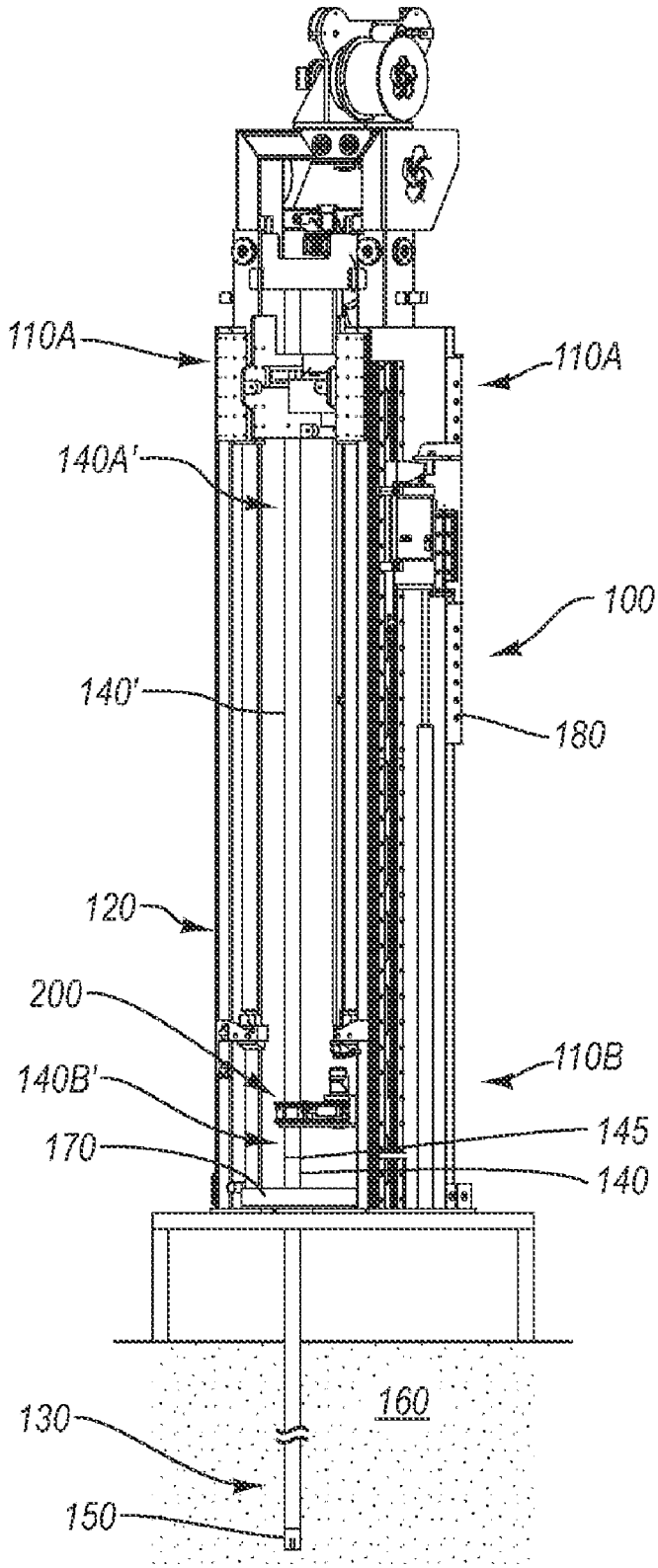
FIG. 1C illustrates a drill rig in which a new drill rod is being coupled to a drill string by the drill rod spinner device.

As illustrated in FIG. 1C, the drill head 120 may then be moved toward the upper end 110A of the mast 110. A rod handling device 180 may then couple an additional drill rod 140' to the drill head 120. In at least one example, a rod handling device 180 may couple the additional drill rod 140' to the system by establishing relative rotation between the additional drill rod 140' and the drill head 120 to thereby cause external threads on the drill head 120 to engage internal threads on an upper end 140A' of the additional drill rod 140'.

The drill head 120 is then lowered to position a lower end 110B' of the additional drill rod 140' relative to the upper end 110A of drill rod 140. With the lower end 110B' of drill rod 140' and the upper end 110A of drill rod 140 in proximity, the drill rod spinner device 200 may be deployed to engage the additional drill rod 140' while the clamping device 170 retains the drill rod 140.

As will be discussed in more detail below, the drill rod spinner device 200 may then rotate the additional drill rod 140' into engagement with the drill rod 140 as well as torque the additional drill rod 140' to the drill rod 140 to a predetermined torque. The rotation and torquing of the additional drill rod 140' may be performed quickly and automatically and without moving an operator into proximity with the mast. As a result, the drill rod spinner device 200 may reduce the time associated with adding a drill rod while increasing safety for operators, such as by reducing the manual repetitive movements associated with rotating and/or torquing the drill rods. The structure and interaction of components in one exemplary drill rod spinner device will first be discussed with reference to FIGS. 2A-2C. Thereafter, the operation of the drill rod spinner device will be discussed with reference to FIGS. 3A-3C.

Figure 2A:
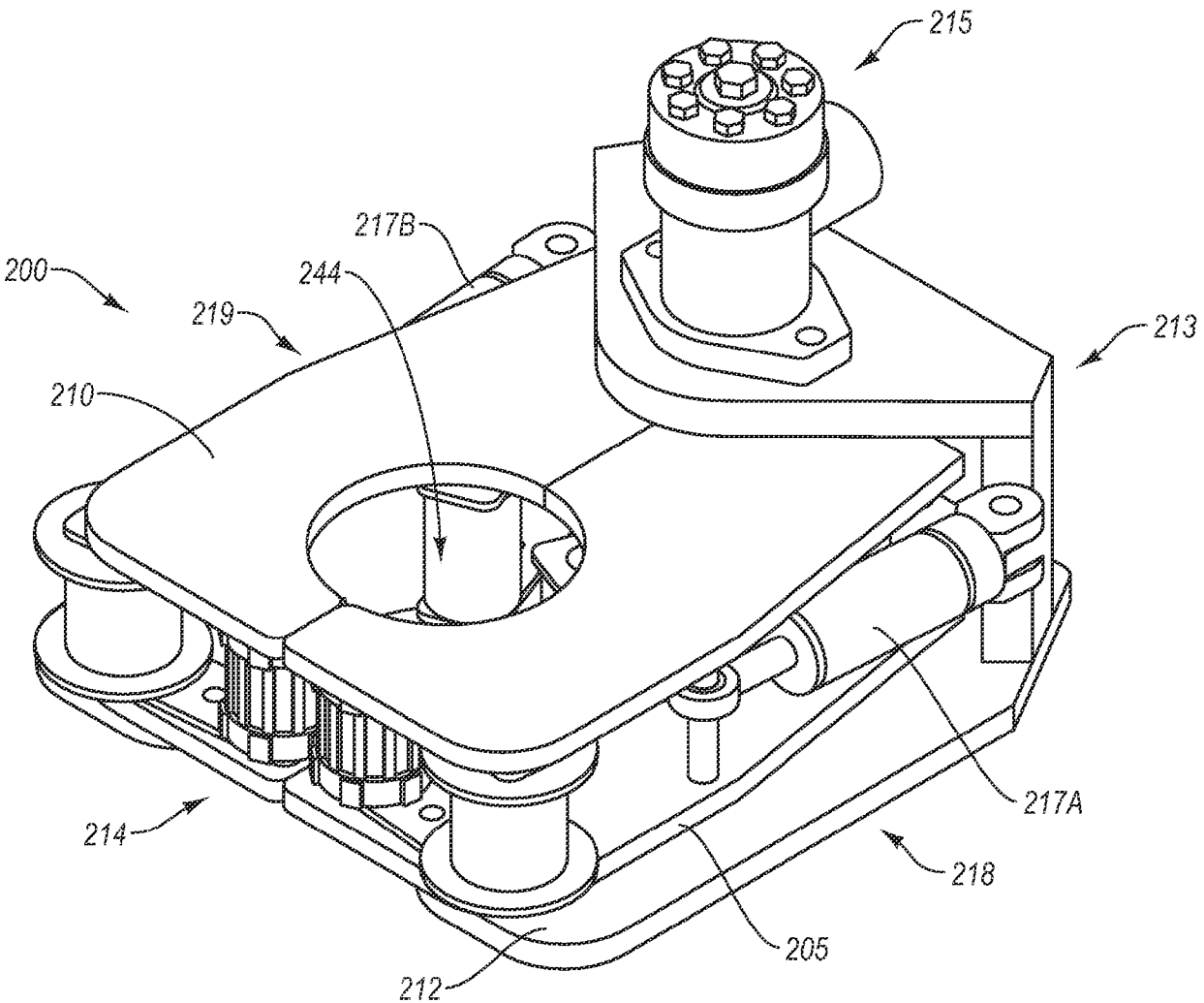
FIG. 2A illustrates a perspective view of drill rod spinner device according to one example.

FIG. 2A illustrates a drill rod spinner device 200 in an engaged state according to one example. As illustrated in FIG. 2A, the drill rod spinner device 200 includes opposing base plates 205, 210 that may be secured to a mount 212, which may be secured to, or be part of, a drill mast. The drill rod spinner device 200 includes a first end 213 and a second end 214. The drill rod spinner device 200 further includes a rotary actuator device 215 that is configured to provide motive power for one or more of the components described below.

In at least one example, the rotary actuator device 215 may be a hydraulically-driven motor that transmits hydraulic power into rotational motion of a driver or pinion. The drill rod spinner device 200 further includes horizontal actuators 217A, 217B, such as pistons, which move the drill rod spinner device 200 between the positions shown in FIG. 2A and FIG. 2B. The horizontal actuators 217A, 217B may be located on first and second sides 218, 219 respectively of the drill rod spinner device.

Figure 2B:
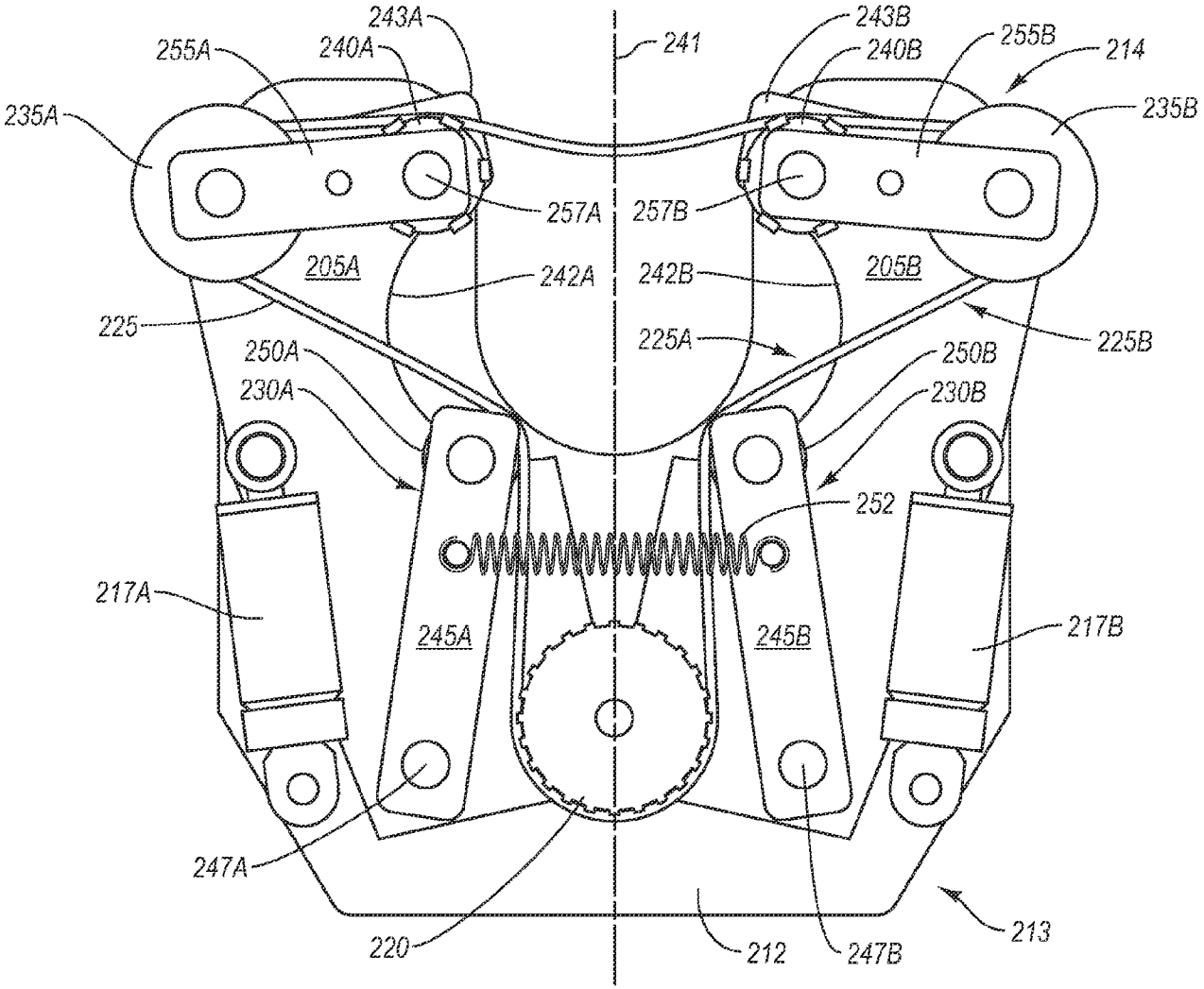
FIG. 2B illustrates a partial plan view of a drill rod spinner device according to one example.

As illustrated in FIG. 2B, the base plate 205 (FIG. 2A) includes a first base half 205A and a second base half 205B. FIG. 2B illustrates a plan view of the drill rod spinner device 200 in which the base plate 210 and the rotary actuator device 215 have been removed. In at least one example, base plate 205 may be symmetrical to base plate 210 such that the discussion of base plate 205 may be applicable to base plate 210. While movement of both base plate halves 205A, 205B is described, it will be appreciated that a single base plate half may be rotated relative to a stationary base plate half to provide similar functionality.

The horizontal actuators 217A, 217B are each attached on one end to the mount 212 and on the other end to the corresponding base half 205A, 205B. The first base half 205A and the second base half 205B are in turn rotatingly coupled to the mount 212. As a result, as the horizontal actuators 217A, 217B are extended toward the second end 214, the first base half 205A and 205B are rotated to thereby horizontally advance and simultaneously draw components on the first and second base halves 205A, 205B toward a centerline 241 of the device 200. As will be discussed in more detail below, the horizontal advancement and closing of the first base half 205A and the second base half 205B position various components to thereby allow the drill rod spinner device 200 to engage and spin elongate members.

These various components include, among others, a toothed pinion 220 operatively associated with the rotary actuator device 215 (FIG. 2A) and a flexible belt 225. The flexible belt 225 is wound around and/or engages the toothed pinion 220, idler assemblies 230A, 230B; pivoting rollers 235A, 235B; and clamping rollers 240A, 240B. In particular, the flexible belt 225 includes an inner portion 225A and an outer portion 225B. The inner portion 225A engages the toothed pinion 220, the pivoting rollers 235A, 235B; and the clamping rollers 240A, 240B while the outer portion 225B engages the idler roller assemblies 230A, 230B.

The idler assemblies 230A, 230B each include link arms 245A, 245B that are pivotingly secured to base plate halves 205A, 205B respectively by way of pivots 247A, 247B. Each of the idler assemblies 230A, 230B includes idler rollers 250A, 250B coupled to the link arms 245A, 245B opposite the pivots 247A, 247B. Accordingly, the link arms 245A, 245B rotate about the pivots 247A, 247B.

A biasing member 252, such as a spring, may couple the link arms 245A, 245B. In at least example, the biasing spring 252 may be coupled to the link arms 245A, 245B at a position on the link arms 245A, 245B that is near the idler rollers 250A, 250B. The biasing member 252 is configured to exert a biasing force on the link arms 245A, 245B that tends to draw the idler rollers 250A, 250B toward the center line 241.

The pivoting rollers 235A, 235B are coupled to the clamping rollers 240A, 240B by way of link arms 255A, 255B. The clamping rollers 240A, 240B are pivotingly coupled to base plate halves 205A, 205B by way of pivots 257A, 257B. Accordingly, the link arms 255A, 255B and consequently the pivoting rollers 235A, 235B rotate about the pivots 257A, 257B.

The positioning of the flexible belt 225 may depend, at least in part on the position of these rollers, which in turn may depend on the position of the base plate halves 205A, 250B. The base plate halves 205A, 205B include inner curved portions 242A, 242B that transition into tabs 243A, 243B near the second end 214 of the drill rod spinner device 200. The clamping rollers 240A, 240B may be located on or near the tabs 243A, 243B. Such a configuration may advance the tabs 243A, 243B horizontally as the horizontal actuators 217A, 217B are employed to move the device toward the engaged position shown in FIG. 2A.

This movement causes the distance between first and second clamping rollers 240A, 240B to decrease. When the tabs 243A, 243B are brought toward the center line 241, the inner curved portions 242A, 242B form a recess 244, as illustrated in FIG. 2A. The recess 244 may be dimensioned to allow a drill rod or other elongate member to be received within the base plate halves 205A, 205B to thereby pass through the drill rod spinner device 200 while allowing the flexible belt 225 and the clamping rollers 240A, 240B to engage elongate members.

Figure 2C:
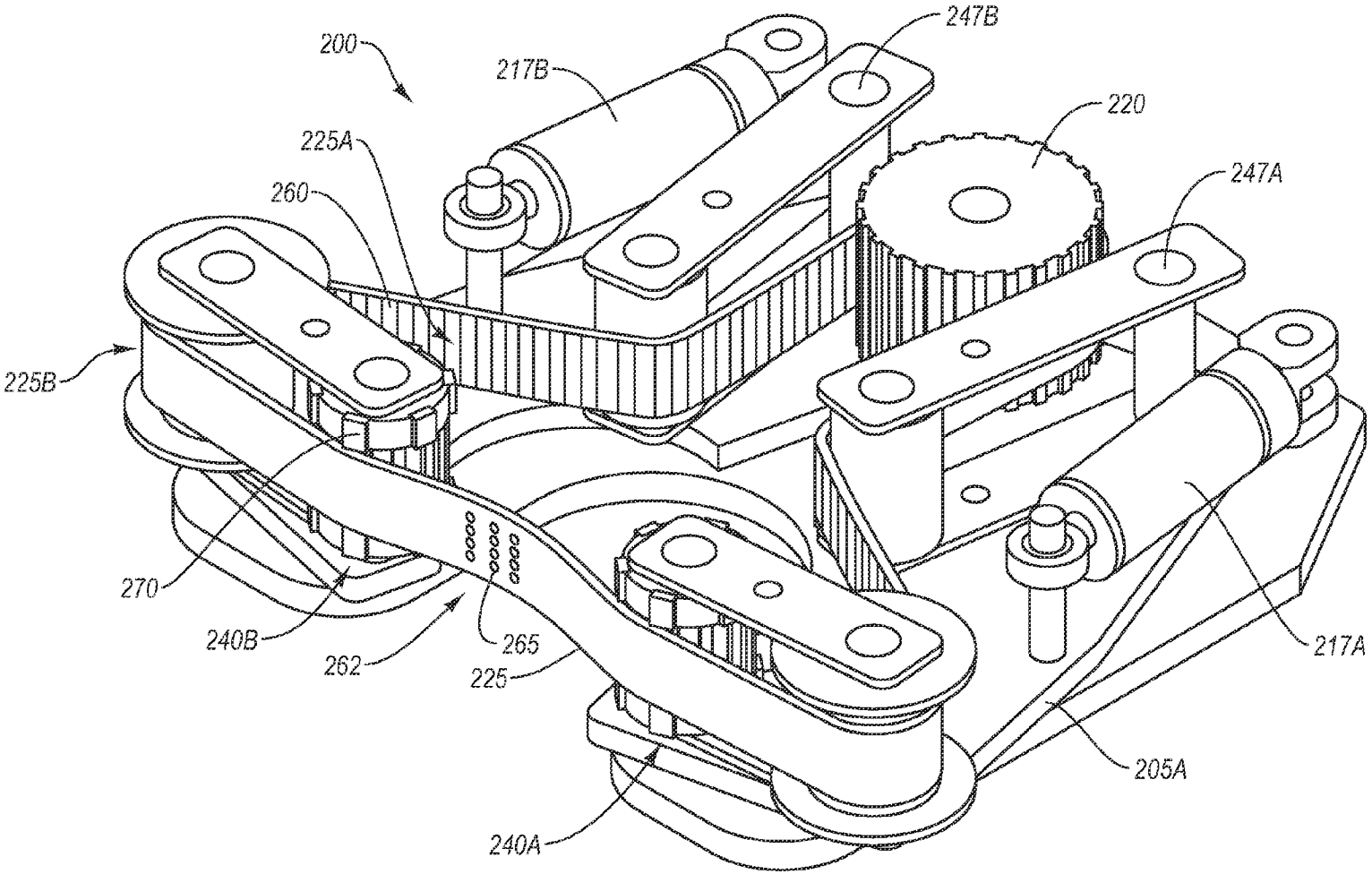
FIG. 2C illustrates a partial perspective view of a drill rod spinner device according to one example.

The flexible belt 225 includes an inner portion 225A and an outer portion 225B. As illustrated in FIG. 2C, at least part of the inner portion 225A may include teeth 260 while at least part of the outer portion 225B may be non-toothed. Further, the inner portion 225A and/or the outer portion 225B of the flexible belt 225 may be treated with an anti-slip treatment in order to enhance the grip of the drill rod spinner device 200 on drill rods.

Further, the drill rod spinner device 200 may also include several features that facilitate rotating and/or torquing of a drill rod to other drill rods and/or the drill head. For example, the flexible belt 225 may include ice-breaking features. In particular, as illustrated in FIG. 2C, the flexible belt 225 may include a studded portion 262, which may include a plurality of individual studs 265 that are embedded in the outer portion 225B of flexible belt 225. The individual studs may include metallic studs, such as tungsten studs. The studs may act to break up ice that has built up on a drill rod. Similarly, such studs may act to enhance grip between the flexible belt 225 and a drill rod that is brought into contact therewith. In at least one example, the studded portion 262 may be an area having a length of approximately 50 mm.

In at least one example, the features described above may include gripping features 270 coupled to at least one of the clamping rollers 240A, 240B. The gripping features 270 may include a plurality of individual gripping features or collective features. Further, the gripping features may be secured to the top and/or bottom of each of the clamping rollers 240A, 240B.

In the illustrated example, the gripping features 270 associated with the clamping rollers 240A, 240B include a plurality of high-friction inserts, such as tungsten inserts, secured to both the top portions and the bottom portions of each of the clamping rollers 240A, 240B. As will be described in more detail below, the flexible belt 225 and the clamping rollers 240A, 240B cooperate to make and break joints. A joint-making operation will first be discussed.

Figure 3A:
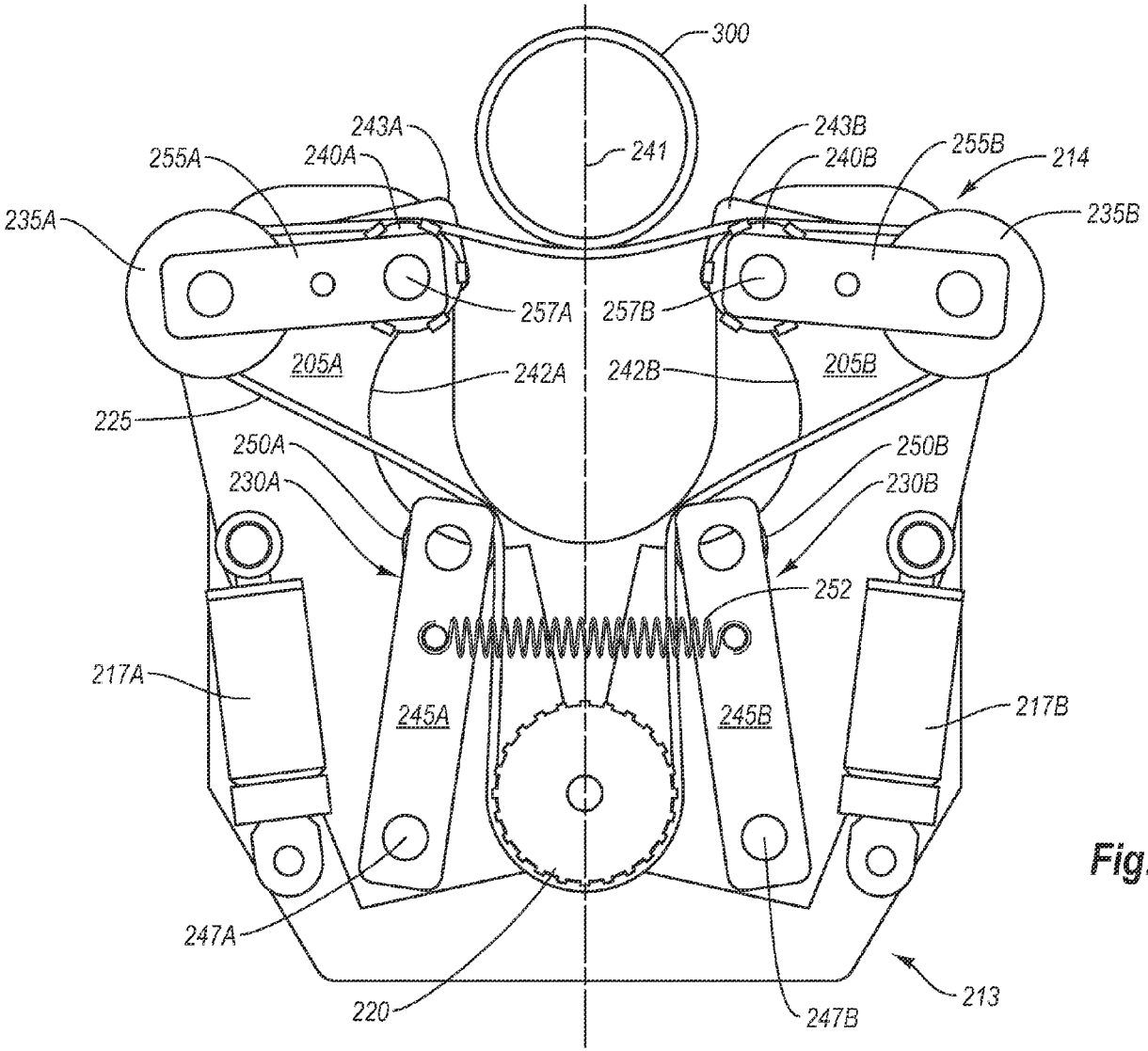
FIG. 3A illustrates a drill rod spinner device in an open position and in proximity with a drill rod according to one example.

FIG. 3A illustrates a first step in engaging a drill rod 300 to one example. As previously introduced, a drill rod may be secured to a drill string by coupling an upper end of the drill rod to a drill head and then positioning a lower end of the drill rod to the upper end of the top drill rod in the drill string. Once the additional drill rod has been secured to the drill head and is thus positioned, the drill rod spinner device 200 may be used as will now be described in more detail. For ease of reference, a single drill rod 300 is shown.

The drill rod 300 generally represents the interaction of the drill rod spinner device 200 with any elongate member, such that the discussion of the drill rod spinner device 200 on the drill rod 300 may be applicable to the system discussed above with reference to FIGS. 1A-1C as well as any other elongate member. While a round drill rod 300 is illustrated, it will be appreciated that the drill rod spinner device 200 may be utilized with any elongate items, including drill rods that have cross-sectional shapes that are not generally round.

As illustrated in FIG. 3A, initially the clamping rollers 240A, 240B may be horizontally offset from the rod 300 while the base plate halves 205A, 205B are separated. From the illustrated state, the clamping rollers 240A, 240B are advanced horizontally to move the drill rod spinner device 200 to the position illustrated in FIG. 3A. For ease of reference, horizontal engagement will be described in which the drill rod spinner device 200, and the base plate halves 205A, 205B are generally perpendicular to the drill rod to be engaged.

Figure 3B:
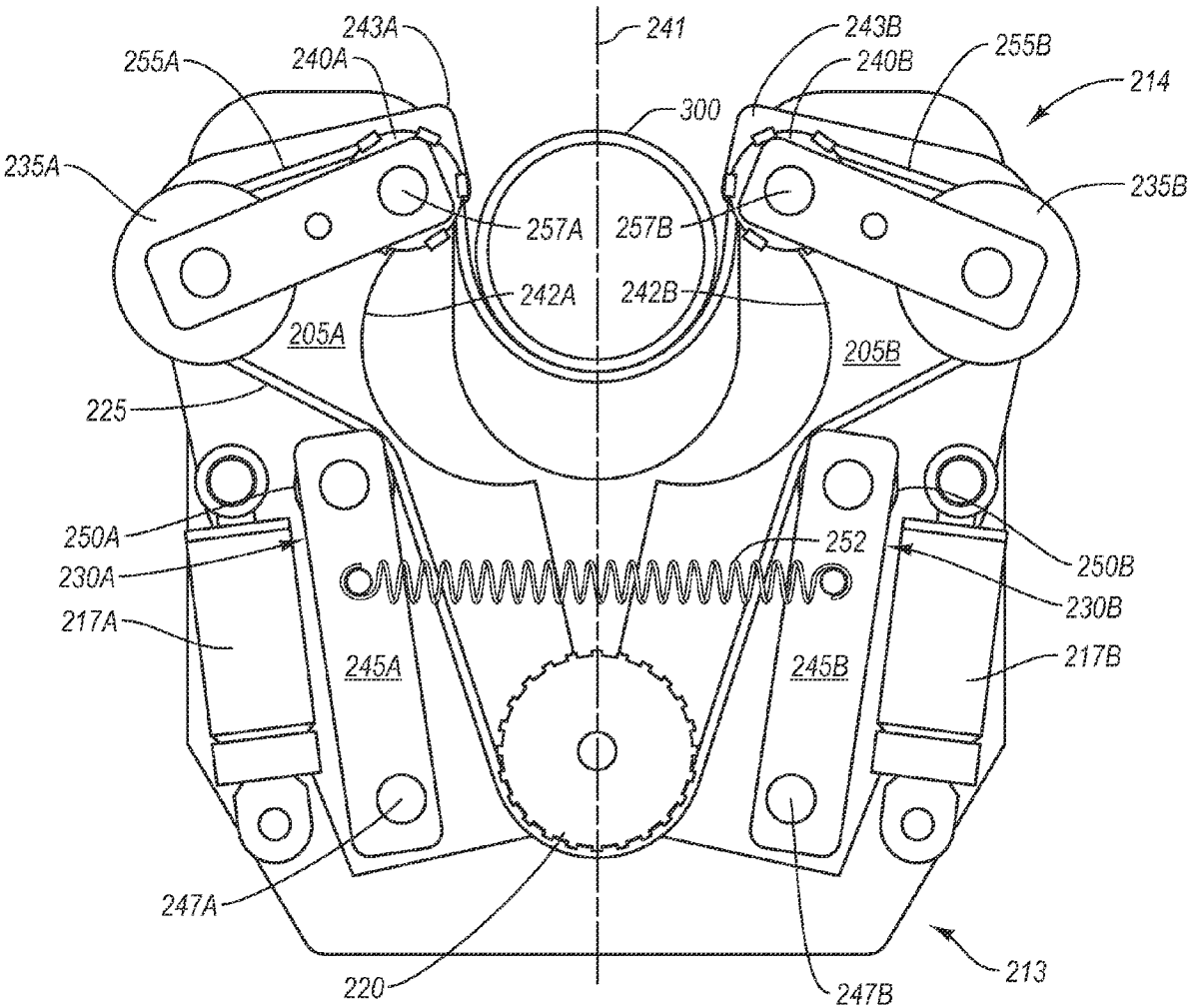
FIG. 3B illustrates a drill rod spinner device in partial engagement with a drill rod according to one example.

In at least one example, horizontal actuators 217A, 217B are deployed to advance the clamping rollers 240A, 240B to the relative positions illustrated in FIG. 3B. While horizontal actuators 217A, 217B are described as positioning the drill rod spinner device 200 generally and the clamping rollers 240A, 240B in particular, it will be appreciated that other devices or actuators may be used for the drill rod spinner device 200 to engage the drill rod 300.

As the clamping rollers 240A, 240B advance horizontally relative to the drill rod 300, contact between the drill rod 300 and the flexible belt 225 increases as the flexible belt 225 begins to wrap around the drill rod 300. While flexible belt 225 may be sufficiently flexible to allow it to be routed around the rollers as described above, the flexible belt 225 may be inextensible about its length. Accordingly, as the flexible belt 225 wraps around the drill rod 300, a portion of the length of flexible belt 225 is engaged. The link arms 245A, 245B may be drawn outward to accommodate a portion of the length of the flexible belt 225 engaged by the additional drill rod 300.

Figure 3C:
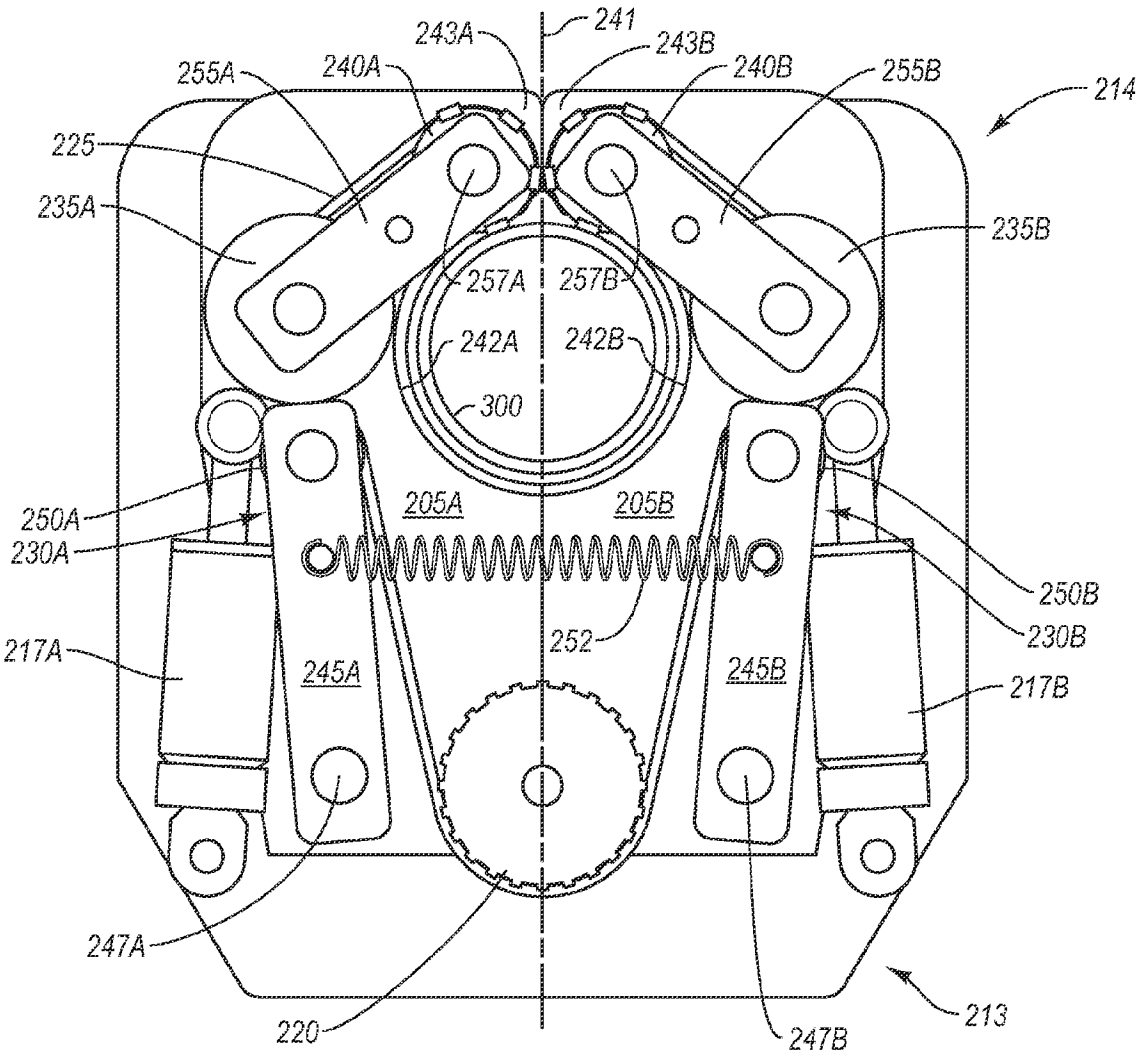
FIG. 3C illustrates a drill rod spinner device in full engagement with a drill rod according to one example.

The horizontal actuators 217A, 217B may be further deployed to thereby move clamping rollers 240A, 240B to the positions illustrated FIG. 3C. As illustrated in FIG. 3C, as the horizontal actuators 217A, 217B are advanced horizontally, the drill rod 300 will be located within the inner curved regions 242A, 242B. Further as illustrated in FIG. 3C, the pivoting rollers 235A, 235B may pivot relative to pivots 257A, 257B to thereby accommodate engagement between the flexible belt 225 and the drill rod 300. Accordingly, rotation of the idler assemblies 230A, 230B and/or the pivoting rollers 235A, 235B relative to the base plate halves 205A, 205B may allow the drill rod spinner device 200 to automatically adjust to receive and engage drill rods having a variety of shapes and sizes.

When the drill rod spinner device 200 engages the drill rod 300, the drill rod 300 is located within the recess 244 (FIG. 2A) such that the drill rod is interior to the clamping rollers 240A, 240B and at least partially wrapped by the flexible belt 225 such that the flexible belt 225 forms a partial loop around the drill rod 300.

Figure 3D:
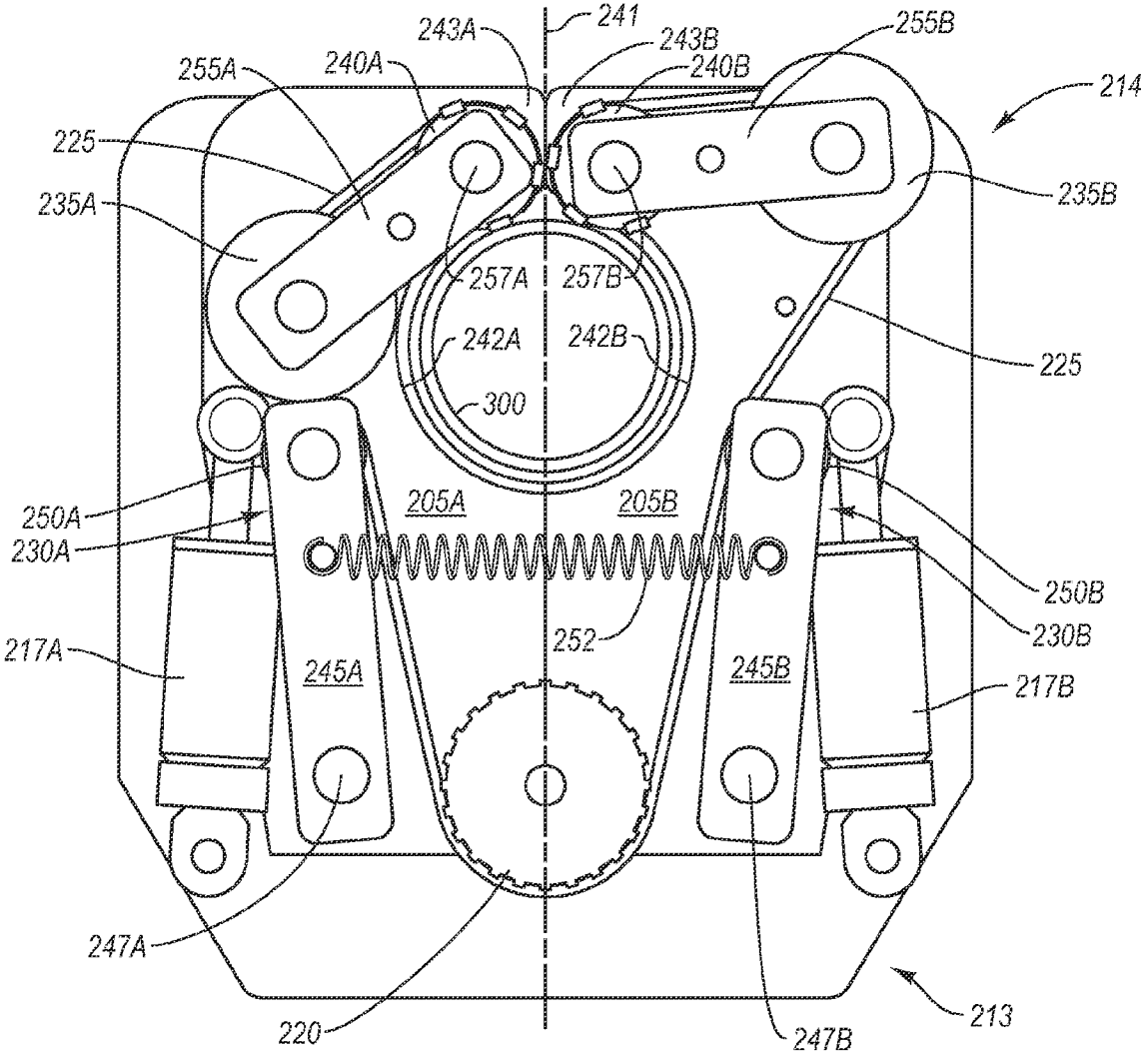
FIG. 3D illustrates a drill rod spinner device in which the drill rod is being rotated according to one example.

As illustrated in FIG. 3D, idler rollers 235A, 235B as well as pivot rollers 250A, 250B may shift to fully accommodate a portion of the belt that may otherwise be slack on the unloaded/returning portion of the flexible belt as the flexible belt is rotated. This action may maintain maximum belt to pinion 220 contact at all times. As the toothed pinion 220 is rotated, the flexible belt 225 is driven in a corresponding direction. In at least one example, the driven toothed pinion 220 may be rotated at relatively high speeds to rotate the drill rod 300 in a clockwise direction and into engagement with a drill rod at the top of the drill string. This first rotation, which may be referred to as a first stage, occurs quickly as the flexible belt 225 is able to rotate quickly with relatively low torque.

As the drill rods come into full engagement, a second stage may begin. In particular, further operation of the rotary actuator device 215 causes the flexible belt 225 to be fully tensioned or stall. As the flexible belt 225 becomes fully tensioned, the tension in the flexible belt 225 pulls the drill rod 300 toward the clamping rollers 240A, 240B and into engagement with the gripping features 270, which may include tungsten inserts on the clamping rollers 240A, 240B while drawing the pivoting roller 235B to the position show in FIG. 3C.

The gripping features 270 may provide enhanced grip on drill rod 300. The enhanced grip between the clamping rollers 240A, 240B and the drill rod 300 may allow for increased torque as the clamping rollers 240A, 240B and the flexible belt 225 rotate at a relatively low speed. The transition between the first stage rotation at high speed and the second state rotation at low speed may occur seamlessly as the pressure in the hydraulic pump smoothly transitions as the belt tightens. Further, in at least one example, the clamping rollers 240A, 240B may be sized such to torque the joint to a desired level. In at least one example, the final joint torque may be between about 1200 Nm or less and about 1500 Nm or more, which may correspond with a hydraulic pressure of between about 10,000 kPa or less and about 18,000 kPa or more.

The joint torque may be selected as desired and may be achieved automatically. For example, as previously introduced, the rotary actuator device 300 may be a hydraulically-driven motor that provides the rotational drive for the toothed pinion. As a result, the rotary actuator device 300 may include a hydraulic relief valve. The relief pressure of the hydraulic relief valve may be selected to correspond to a desired torque level to be applied to the joint. Accordingly, the joint torque may be achieved when the hydraulic pressure of the rotary actuator circuit relieves. Once the drill rod 300 has been properly torqued, the horizontal actuators 217A, 217B may return the drill spinner device to the rest state to unwrap the flexible belt 225.

The drill rod spinner device 200 may also engage a drill rod having a diameter smaller than the drill rod 300 of FIG. 3C. In particular, the biasing member 252 may exert a biasing force on the idler assemblies 230A, 230B as described above. The biasing force and tension in the belt may then act to draw the idler rollers 250A, 250B toward the centerline 241 and/or act to rotate the link arms 255A, 255B and the associated pivoting rollers 235A, 235B to thereby accommodate the full length of the flexible belt 225, which may help ensure the flexible belt 225 engages the drill rod. Accordingly, the drill rod spinner device 200 is configured to engage drill rods or other elongate items of varying sizes and/or shapes.

To this point, the drill rod spinner device 200 has been discussed in the context of a drilling operation in which drill rods are being added to the drill string. The drill rod spinner device 200 may also be used during a drilling operation where the drill string is being withdrawn.

Figure 4A:
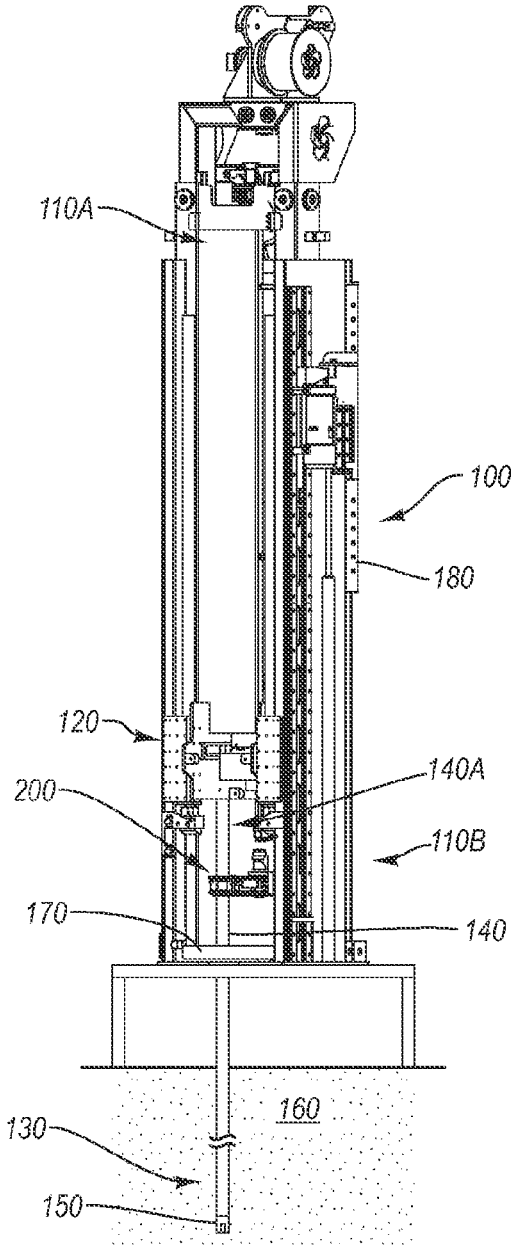
FIG. 4A illustrates an elevation view of a drill rig with a drill rod spinner device associated therewith according to one example.

FIG. 4A illustrates a drill rig 100 in which a drill rod 140 is to be removed. In particular, in such an operation the drill head 120 may be positioned on the mast 110 such that the upper end 140A of the drill rod 140 is just above the clamping device 170. The clamping device 170 may then clamp the upper end 140A of the drill rod. The drill head 120 may then be rotated in a second direction to thereby loosen the connection between the drill head 120 and the drill rod 140 without decoupling the drill rod 140 completely from the drill head 120.

Figure 4B:
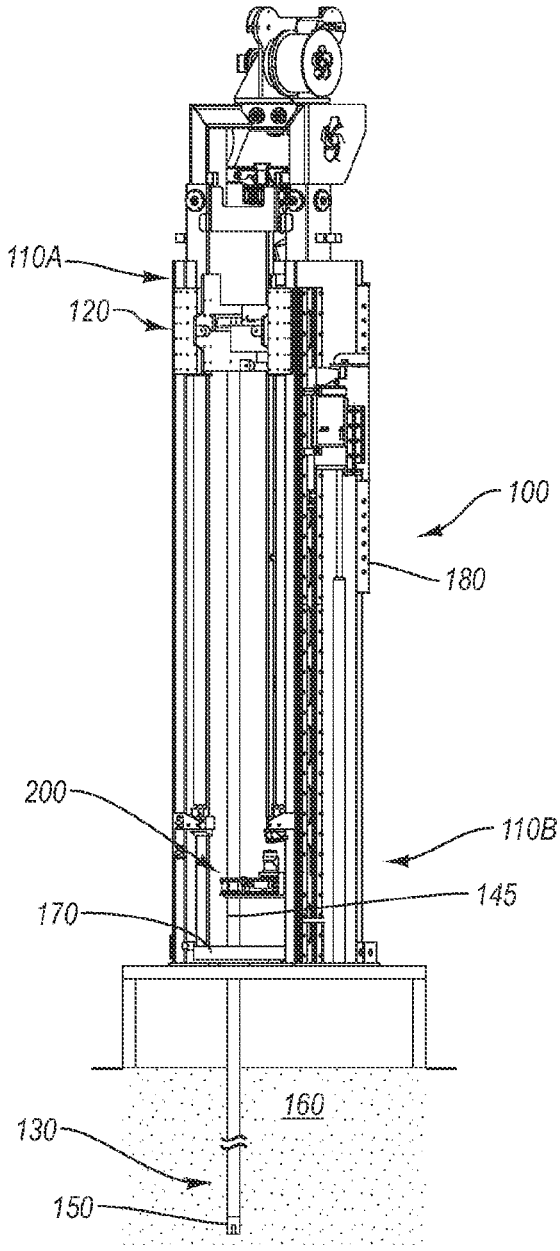
FIG. 4B illustrates an elevation view of a drill rig with a drill rod spinner device associated therewith according to one example.

As illustrated in FIG. 4B, the drill head 120 may then be moved toward the upper end 110A of the mast 110 to thereby position the joint 145 between the clamping device 170 and the drill rod spinner device 200. The clamping device 170 may again clamp the drill rod 140 and the drill rod spinner device 200 actuated to engage the drill rod 140.

The drill rod spinning device 200 may then be deployed. In particular, turning again to FIG. 3C, the toothed pinion 220 is driven to achieve counter clockwise rotation of the elongate member. The gripping features 270 may apply a high-torque to the drill rod 140 to break the joint 145 (FIG. 4B) at low speeds. Once the joint 145 has been broken, the toothed pinion 220 may, at a higher speed, unthread the drill rod 140 from the drill string 150. The toothed pinion 220 may continue to be rotated to effect breaking of the joint 145. The drill head 120 (FIG. 4B) is then raised allowing the drill rod 140 to be removed by a rod handling device or system.

A drill rod spinner device has been provided herein that is configured to make and/or break joints between drill rods to facilitate introduction and/or removal of drill rods to and/or from a drill string as part of a drilling operation. In at least one example, the drill rod spinner device is configured to engage elongate members, such as drill rods, of varying sizes and/or shapes. The drill rod spinner device may include a flexible belt that is driven by a rotary actuator device. The flexible belt is routed around a number of pulleys, including around and between two clamping pulleys. The flexible belt between the two clamping pulleys may be formed into a loop that engages an elongate member. For example, the clamping pulley may be coupled to a hinged, two-part base that is configured to move between a rest state in which the clamping pulleys are separated and a engaged state in which the pulleys are brought toward each other. The relationship between the pulleys and the belt allows the belt to automatically engage elongate members and to apply rotating forces to the elongate members.

Further, during a drilling operation in which drill rods are to be added, the configuration of the drill rod spinner device quickly rotates an engaged drill rod into engagement with an adjacent drill rod during a first stage of the process and then seamlessly transitions to a second stage to automatically torque the drill rod to a desired torque. Similarly, the drill rod spinner device may torque a drill rod to thereby break the joint between a drill rod and an adjacent drill rod during a first stage of a drill rod removal process and then seamlessly transition to a second stage to quickly decouple the drill rod from the adjacent drill rod.

The present disclosure may be embodied in other specific forms without departing from its spirit or essential characteristics. The described examples are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A drill rod spinner device, comprising:

a mount;

a first base half having a first end and a second end, wherein the first base half at the first end is rotatably coupled to the mount;

a first clamping roller operatively associated with the second end of the first base half;

a second base half having a first end and a second end, wherein the second base half at the first end is coupled to the mount;

a second clamping roller operatively associated with the second end of the second base half;

a rotary actuator assembly secured to the mount;

a flexible belt operatively associated with the rotary actuator assembly, the flexible belt having a first surface and an opposing second surface, wherein the first surface engages engaging the first clamping roller and the second clamping roller; and an idler roller assembly comprising first and second idler rollers configured to translate relative to at least one of the first base half and the second base half to maintain engagement between the flexible belt and the rotary actuator as the first base half is rotated relative to the mount, wherein the second surface of the flexible belt engages the first and second idler rollers, and wherein the first and second idler rollers are capable of movement toward or away from each other during use of the drill rod spinner device.

2. The drill rod spinner device of claim 1, further comprising a first horizontal actuator operatively associated with the first base half, the first horizontal actuator being configured to move the first base half between a rest state and an engaged state, wherein in the rest state the first clamping roller and the second clamping roller are separated by a first distance and wherein in the engaged state the first clamping roller and the second clamping roller are separated by a second distance, the second distance being smaller than the first distance.

3. The drill rod spinner device of claim 2, wherein the rotary actuator device, the idler roller assembly, and the flexible belt are configured to cooperate to rotate an elongate member to an adjacent elongate member at a first torque and to torque the elongate member to the adjacent elongate member at a second torque.

4. The drill rod spinner device of claim 3, wherein the rotary actuator device, the idler roller assembly, and the flexible belt are configured to cooperate to draw the elongate member into at least one of the first clamping roller and the second clamping roller to thereby torque the elongate member to the adjacent elongate member at the second torque.

5. The drill rod of claim 1, wherein the first end of the second base half is rotatingly coupled to the mount.

6. The drill rod spinner device of claim 1, further comprising a first pivoting roller operatively associated with the first clamping roller and a second pivoting roller operatively associated with the second clamping roller, wherein the first surface of the flexible belt engages the first pivoting roller and the second pivoting roller.

7. The drill rod spinner device of claim 6, further comprising a first link arm coupling the first pivoting roller to the first clamping roller and a second link arm coupling the second pivoting roller to the second clamping roller.

8. The drill rod spinner device of claim 1, wherein the first idler roller is secured to the first base half and the second idler roller is secured to the second base half.

9. The drill rod spinner device of claim 1, further comprising a biasing member coupling the first idler roller to the second idler roller.

10. The drill rod spinner device of claim 1, further comprising a plurality of metallic studs embedded in the flexible belt.

11. The drill rod spinner device of claim 10, wherein the metallic studs include tungsten studs embedded in the flexible belt.

12. The drill rod spinner device of claim 1, further comprising gripping features coupled to at least one of the clamping rollers.

13. The drill rod spinner device of claim 12, wherein the gripping features include tungsten inserts secured to at least one of the first clamping roller or the second clamping roller.

14. The drill rod spinner device of claim 1, wherein the rotary actuator device includes a rotary hydraulic engine and a toothed pinion.

15. The drill rod spinner device of claim 1, wherein the first end of the second base half is pivotingly coupled to the mount.

16. A drill rod spinner device, comprising:

a rotary actuator assembly;

a first clamping roller having gripping features associated therewith;

a second clamping roller;

an idler roller assembly comprising a first idler roller, a second idler roller and a biasing member, the biasing member adapted to bias the first and second idler rollers toward each other; and a flexible belt engaging the rotary actuator assembly, the idler roller assembly, the first clamping roller, and the second clamping roller, wherein the idler roller assembly is configured to cooperate with the first clamping roller and the second clamping roller to move the flexible belt to rotate an elongate member relative to an adjacent elongate member and to pull the elongate member into the gripping features on the first clamping roller to torque the elongate member relative the adjacent elongate member.

17. The drill rod spinner device of claim 16, wherein the first clamping roller is operatively associated with a first base half and the second clamping roller is operatively associated with a second base half, wherein the first base half and the second base half are configured to be moved between a rest state and an engaged state, wherein in the rest state the first clamping roller and the second clamping roller are separated by a first distance and wherein in the engaged state the first clamping roller and the second clamping roller are separated by a second distance, the second distance being smaller than the first distance.

18. The drill rod spinner device of claim 17, wherein the idler roller assembly includes a first pivot link arm coupling the first clamping roller to a first pivoting roller and a second pivot link arm coupling the second clamping roller to a second pivoting roller, wherein the first pivot link arm is configured to rotate relative to the first base half and the second pivot link arm is configured to rotate relative to the second base half.

19. The drill rod spinner device of claim 18, wherein the idler roller assembly includes a first idler link arm rotatingly coupling the first idler roller to the first base half and a second idler link arm rotatingly coupling the second idler roller to the second base half and wherein movement of at least one of the first idler link arm, the second idler link arm, the first pivot link arm, and the second pivot link arm accommodates the flexible belt as the elongate member is pulled into the gripping features.

20. The drill rod spinner device of claim 18, wherein the flexible belt includes an first surface engaging the first clamping roller and the second clamping roller; the flexible belt further including a second surface opposite the first surface, the second surface engaging the first idler roller and the second idler roller.

21. The drill rod spinner device of claim 18, wherein the flexible belt includes an ice breaking features operatively associated therewith.

22. The drill rod spinner device of claim 18, wherein the ice breaking features include a plurality of tungsten studs embedded in the flexible belt.

23. The drill rod spinner device of claim 16, wherein the biasing member comprises a spring.

24. A drill mast, comprising:

a support structure; and a drill rod spinner device coupled to the support structure, the drill rod spinner device including a rotary actuator assembly, a first clamping roller having gripping features associated therewith, a second clamping roller, an idler roller assembly comprising first and second idler rollers adapted to move toward or away from each other during use of the drill rod spinner device, and a flexible belt engaging the rotary actuator assembly and the idler assembly, the first clamping roller, and the second clamping roller, wherein the idler roller assembly is configured to cooperate with the first clamping roller and the second clamping roller to move the flexible belt to rotate an elongate member into engagement with an adjacent elongate member and to pull elongate member into the gripping features on the first clamping roller to torque the elongate member to the adjacent elongate member.

25. The drill mast of claim 22, further comprising a clamping device coupled to the support structure.

26. The drill mast of claim 22, further comprising a drill head coupled to the support structure.

27. A method of spinning an drill rod, comprising:

moving a drill rod spinner device into engagement with a drill rod, the drill rod spinner device including a rotary actuator assembly, a first clamping roller having gripping features associated therewith, a second clamping roller, an idler roller assembly; and a flexible belt engaging the rotary actuator assembly and the idler roller assembly;

rotating the rotary actuator assembly at a first speed to drive the flexible belt to rotate the drill rod; and rotating the rotary actuator assembly at a second speed to pull the drill rod into gripping features associated with at least one of the first clamping roller and the second clamping roller to apply torque to the drill rod with at least one of the first clamping roller and the second clamping roller, the second speed being lower than the first speed.

28. The method of claim 26, wherein the step of rotating the actuator at a second speed occurs before the step of rotating the rotary actuator at a first speed as part of a joint breaking process.

29. The method of claim 26, wherein rotating the rotary actuator assembly includes driving a hydraulically-driven motor.

* * * * *

UNITED STATES PATENT AND TRADEMARK OFFICE

CERTIFICATE OF CORRECTION

PATENT NO. : 7,849,929 B2
APPLICATION NO. : 12/119385
DATED : December 14, 2010
INVENTOR(S) : Littlely It is certified that error appears in the above-identified patent and that said Letters Patent is hereby corrected as shown below:

Column 1
Line 25, change "string rotate" to --string to rotate--
Line 36, remove the second instance of [advanced from]

Column 2
Line 35, change "member to and to" to --member and to--

Column 5
Line 11, change "110B'" to --140B'--
Line 12, change "110B'" to --140B'--

Column 6
Line 28, change "least example" to --least one example--
Line 44, change "250B" to --205B--

Column 8
Line 34, change "idler rollers 235A, 235B" to --idler rollers 250A, 250B--
Line 35, change "pivot rollers 250A, 250B" to --pivot rollers 235A, 235B--

Column 9
Line 58, change "drill string 150" to --drill string 130--

Column 10
Line 9, change "a engaged state" to --an engaged state--
Line 50, change "engages engaging" to --engages--

Column 12
Line 33, change "includes an first" to --includes a first--
Line 39, change "includes an ice breaking features" to --includes ice breaking features--

Signed and Sealed this
Sixteenth Day of August, 2011

David J. Kappos

David J. Kappos
*Director of the United States Patent and Trademark Office*

Line 50, change “including” to --including:--

Column 13
Line 5, change “spinning an drill rod” to --spinning a drill rod--
Line 11, change “assembly; and” to --assembly, and--